US007583909B2

(12) United States Patent
Imamiya

(10) Patent No.: US 7,583,909 B2
(45) **Date of Patent: *Sep. 1, 2009**

(54) IMAGE FORMING APPARATUS AND IMAGE FORMING METHOD USING DECOLORIZING TONER

(75) Inventor: Koji Imamiya, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 159 days.

This patent is subject to a terminal disclaimer.

(21) Appl. No.: 11/694,208

(22) Filed: Mar. 30, 2007

(65) Prior Publication Data

US 2007/0166065 A1 Jul. 19, 2007

Related U.S. Application Data

(62) Division of application No. 11/068,894, filed on Mar. 2, 2005, now Pat. No. 7,203,436.

(51) Int. Cl.
*G03G 15/00* (2006.01)
*G03G 15/06* (2006.01)

(52) U.S. Cl. ..... 399/49; 399/55

(58) Field of Classification Search ..... 399/49, 399/53, 54, 55, 56

See application file for complete search history.

(56) References Cited

U.S. PATENT DOCUMENTS 5,814,427 A 9/1998 Murofushi et al.
2006/0088350 A1 4/2006 Imamiya

FOREIGN PATENT DOCUMENTS

JP 5-127572 A 5/1993
JP 7-020666 A 1/1995

OTHER PUBLICATIONS

Toshiba's "e-blue(TM)" Decolorable Toner and Erasing Machine, Dec. 2, 2003, http://www.toshiba.co.jp/about/press/2003_12/pro0201.html.

*Primary Examiner*—Hoang Ngo
(74) *Attorney, Agent, or Firm*—Foley & Lardner LLP

(57) ABSTRACT

An amount of toner adhered to a toner image formed on the photosensitive drum using decolorizing toner when forming an image is controlled to 0.75 (mg/cm$^2$) or below. As a result, a toner image formed on a paper is erased satisfactorily for the purpose of reusing the paper and the image density remaining on the paper is lowered.

20 Claims, 7 Drawing Sheets

IMAGE FORMING APPARATUS AND IMAGE FORMING METHOD USING DECOLORIZING TONER

CROSS-REFERENCE TO RELATED APPLICATIONS

The present application is a division of U.S. application Ser. No. 11/068,894, filed Mar. 2, 2005, the entire contents of which are incorporated herein by reference.

BACKGROUND OF THE INVENTION

1. Field of the Invention

The present invention relates to an image forming apparatus such as copier, printer, facsimile, etc. capable of forming images and repetitively erasing toner images formed on paper, in particular, an image forming apparatus and an image forming method that define amounts of toners adhered on a photosensitive drum.

2. Description of the Related Art

In recent years, a large volume of paper is consumed with the increase of various informational data according to the development of the office automation. On the other hand, sheets of paper are recycled so far for the purpose of saving of paper resources. For example, in the paper recycle, recycled paper is manufactured by processing used sheets of paper with toner image data formed thereon using a voluminous amount of bleaching agent and water. As a result, in the paper recycling, cost of recycled paper is increased and economical efficiency of the paper recycle is impaired and a new environmental pollution may be produced as a result of the processing of waste solution used in the recycling of used paper.

In view of the above, a practical application is attempted to reuse once used paper by erasing image data printed thereon for printing new image data output repeatedly instead of recycling paper by recycling used paper itself in recent years. For reusing used paper, an image is formed or erased using decolorizing toner by cutting off the connection of toner pigment with coupler fixed on paper by heating and the same paper is used repeatedly. When this reused paper is used repetitively, the paper quality will be deteriorated.

So, an image forming apparatus equipped with a toner adhering amount detecting means for detecting amount of toner adhering on a transfer paper is so far disclosed in the Japanese Patent Application Publication No. 7-20666. This conventional image forming apparatus controls the image forming process on a transfer paper according to a toner adhering amount on a reused transfer paper or discards a reused transfer paper.

However, this conventional image forming apparatus is able to control the image forming process by recognizing a characteristic change in the history of reused transfer paper. However, it does not control developing density of decolorizing toner at the time when an image was formed; that is, amount of decolorizing toner adhering to the photosensitive drum.

On the other hand, if the density of a toner image transferred on a paper and fixed thereon was high, the toner decolorization for reusing paper becomes worse. If the density of an image left on a paper after decolorizing toner became to more than 0.2, a previous image not erased and remained becomes conspicuous and a newly printed data will become difficult to read when new data is printed.

So, an image forming apparatus and an image forming method for forming images in good toner decolorizing property after fixed and making it possible to read a newly printed image satisfactorily when forming images using reuse paper are demanded.

SUMMARY OF THE INVENTION

An object of the present invention is to provide an image forming apparatus and an image forming method capable of improving decolorization of a toner image after transferring and fixing it on a paper by adjusting toner amount adhering on a photosensitive drum when forming an image and making it possible to easily read an image newly printed on reuse paper.

According to the embodiments of this invention, an image forming apparatus is characterized in that it has an image carrier, a latent image forming mean to form an electrostatic latent image on the image carrier and a developing means to form a toner image by adhering a decolorizing toner to the electrostatic latent image formed on the image carrier, and amount of decolorizing toner adhered on the image carrier by the developing means is less than 0.75 mg/cm$^2$.

DETAILED DESCRIPTION OF THE INVENTION

Figure 1:
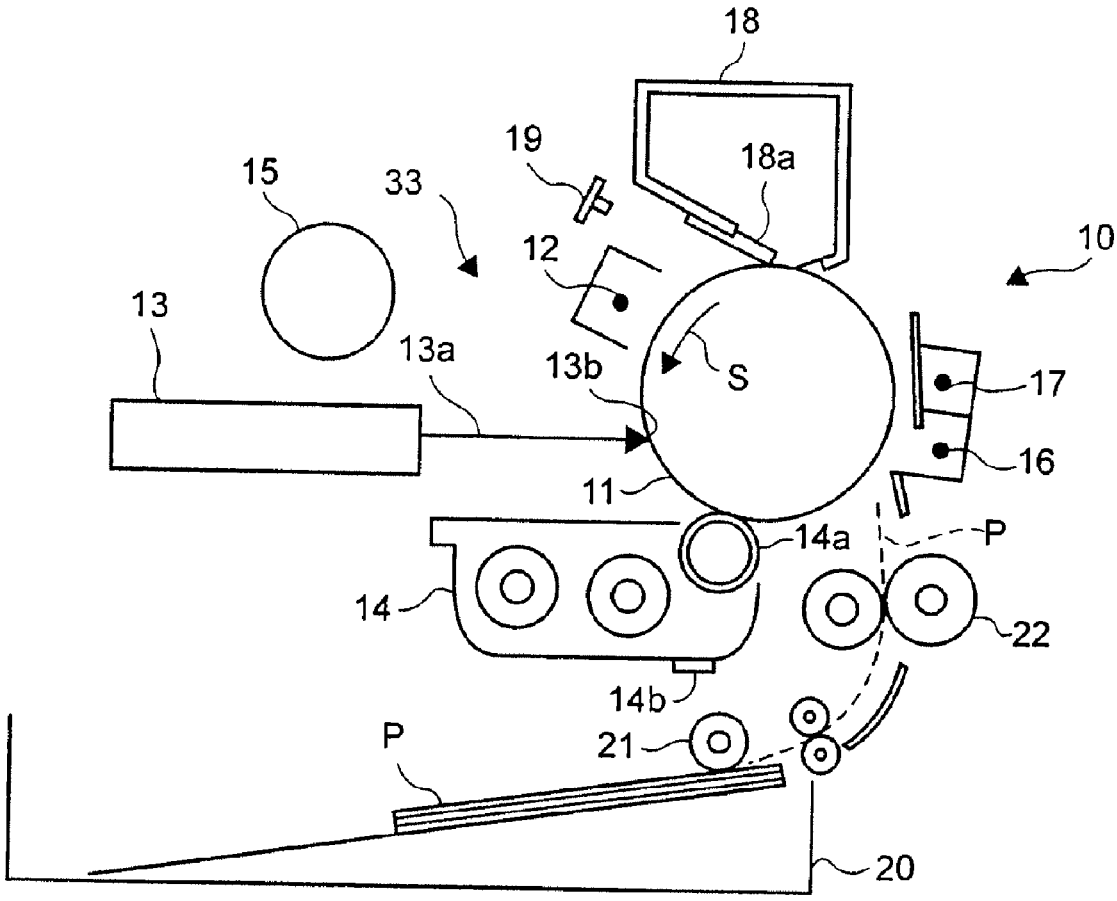
FIG. 1 is a schematic diagram showing and image forming unit of an image forming apparatus in a first embodiment of the present invention.

The embodiments of the present invention will be described below in detail referring to the attached drawings. FIG. 1 is the first embodiment of the present invention showing an image forming unit 10 of an image forming apparatus such as a copier, etc. The image forming apparatus in this embodiment forms an image using toner that is decolorizing when heated. Further, the image forming apparatus is capable of forming an image on paper that is repeatedly used by decolorizing a toner image.

A photosensitive drum 11 that is an image carrier of image forming unit 10 has an organic photoconductor (OPC) on the surface of a ϕ60 mm supporting member and is driven in the arrow direction s at a peripheral velocity of 215 mm/sec. In the periphery of photosensitive drum 11, a main charger 12 and an exposure unit 13 both of which comprise a latent image forming unit 33 are provided. Main charger 12 charges the surface of photosensitive drum 11 uniformly to −750V. Exposure unit 13 irradiates laser beam 13*a* corresponding to image data to an irradiation position of uniformly charged photosensitive drum 11. Further, in the vicinity of photosensitive drum 11, a developing unit 14, a transfer charger 16, a separation charger 17, a cleaner having a cleaning blade 18*a* and a charge elimination LED 19 are arranged. Toner is supplied to developing unit 14 as required from a toner supply unit 15. Paper P that is a recording medium is taken out from a paper supply cassette unit 20 by a paper supply roller 21 conveyed to a transfer charger position 16 of image forming unit 10 in sync with a toner image on photosensitive drum 11 by an aligning roller 22. Paper supply cassette unit 20 is able to supply both unused paper and reuse paper.

Figure 2:
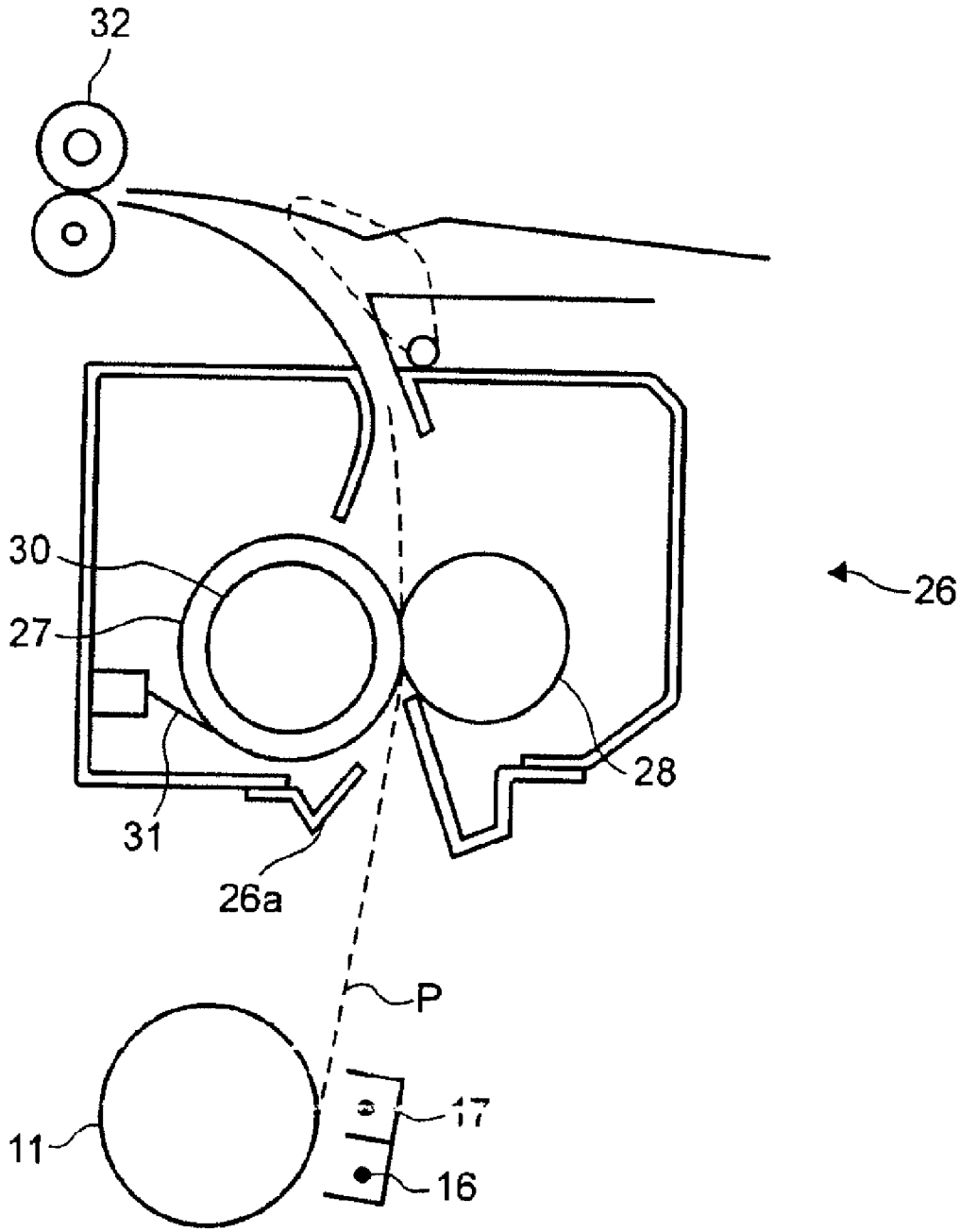
FIG. 2 is a schematic construction diagram showing a fixing unit in the first embodiment of the present invention.

Above image forming unit 10, there is arranged a fixing unit 26 shown in FIG. 2 for heating, pressing and fixing paper P that is a recording paper carrying an unfixed toner image formed in color decolorizing toner by image forming unit 10. Fixing unit 26 has a fixing roller 27 that is a fixing rotary member and a pressing roller 28 that is a pressing rotary member that is in pressure contact with this fixing roller 27. Further, fixing unit 26 has an inlet guide 26*a* to lead paper P into a nip between fixing roller 27 and pressing roller 28.

Fixing roller 27 is an iron made hollow cylinder coated with PTFE (polytetrafluoroethylene) on its surface. Fixing roller 27 has an IH coil (induction heating coil) 30 in the inside to heat fixing roller 27 directly from the inside. The current of IH coil 30 is controlled by a controller (not shown) according to the output of a Thermistor (thermo-sensor) 31 that is in contact with the surface of fixing roller 27 and detects the temperature and controls it to a specified temperature. At the downstream side in the conveying direction of paper P of fixing unit 26, there is provided a discharge roller 32 to discharge paper P after fixing in the specified direction.

A developing unit 14 of image forming unit 10 uses a two-component developing agent that is a mixture of toner in mean volumetric particle size 8 to 12 μm and magnetic carrier in mean volumetric particle size 60 to 80 μm. Toner is an "Decolorize toner e-blue (the registered trademark of Kabushiki Kaisha Toshiba) (hereinafter, referred to as an decolorizing toner)". This toner is obtained by kneading binder resin and pigment, coloring agent, erasing agent, WAX, etc. and by grinding and classifying the obtained knead product and adding an additive. True specific gravity of decolorizing toner is in the range of 0.9 to 1.2 g/cm$^3$.

Decolorizing toner is decolorized by cutting the connection of toner's pigment and a coloring agent by heating a paper printed with a toner image at 120 to 150° C. for about 2 hours. Developing bias of about −550V is applied to developing roller 14*a* of developing unit 14 and a toner image is formed for an electrostatic latent image on photosensitive drum 11 by the reverse development.

Figure 3:
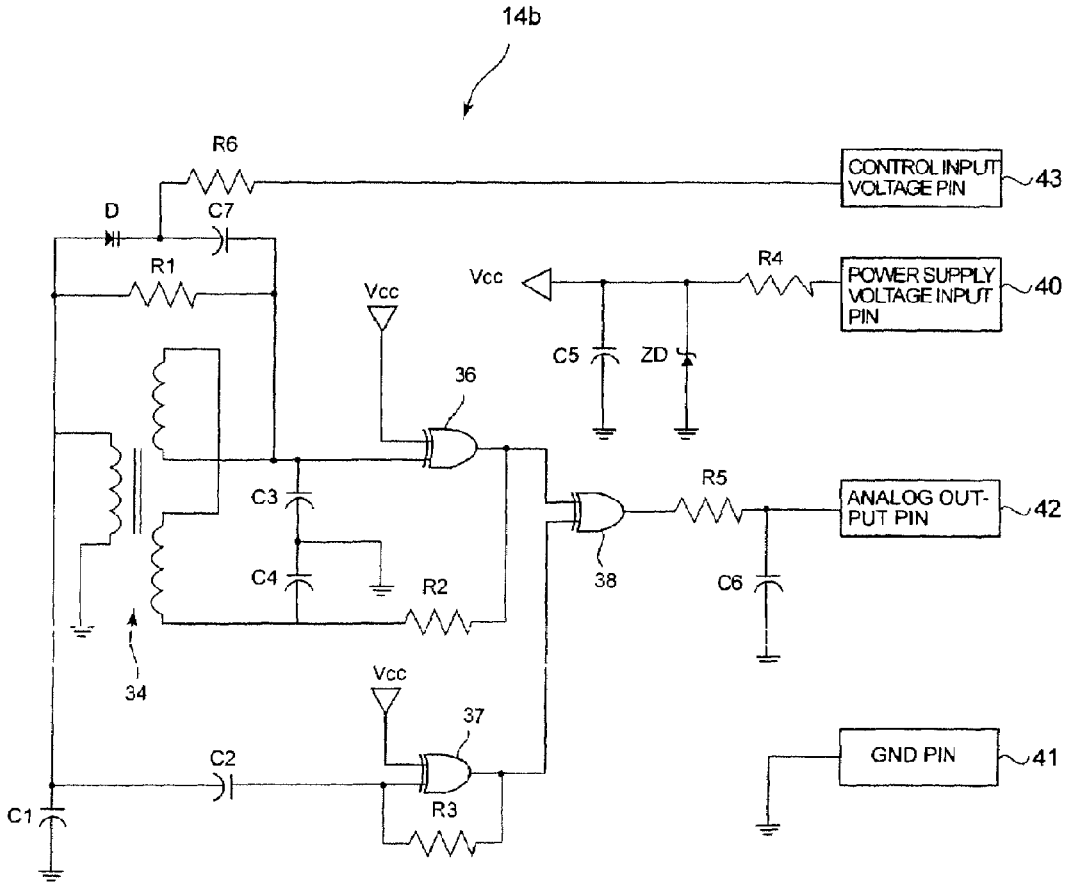
FIG. 3 is a circuit diagram showing a magnetic sensor in the first embodiment of the present invention.

Developing unit 14 is provided with a magnetic sensor 14*b* to detect a specific toner density of two-component developing agent in a developer container. Magnetic sensor 14*b* is for detecting magnetic permeability of developing agent and its circuit diagram is shown in FIG. 3. Magnetic sensor 14*b* has a supply voltage input pin 40 to input 24V voltage to a transformer 34, a GND pin 41, an analog output pin 42 to output analog output according to change in specific density of toner, and a control input voltage pin 43 to input control voltage value Vc for output adjustment. Further, all ICs are composed of EX-OR gates 36, 37 and 38.

Figure 4:
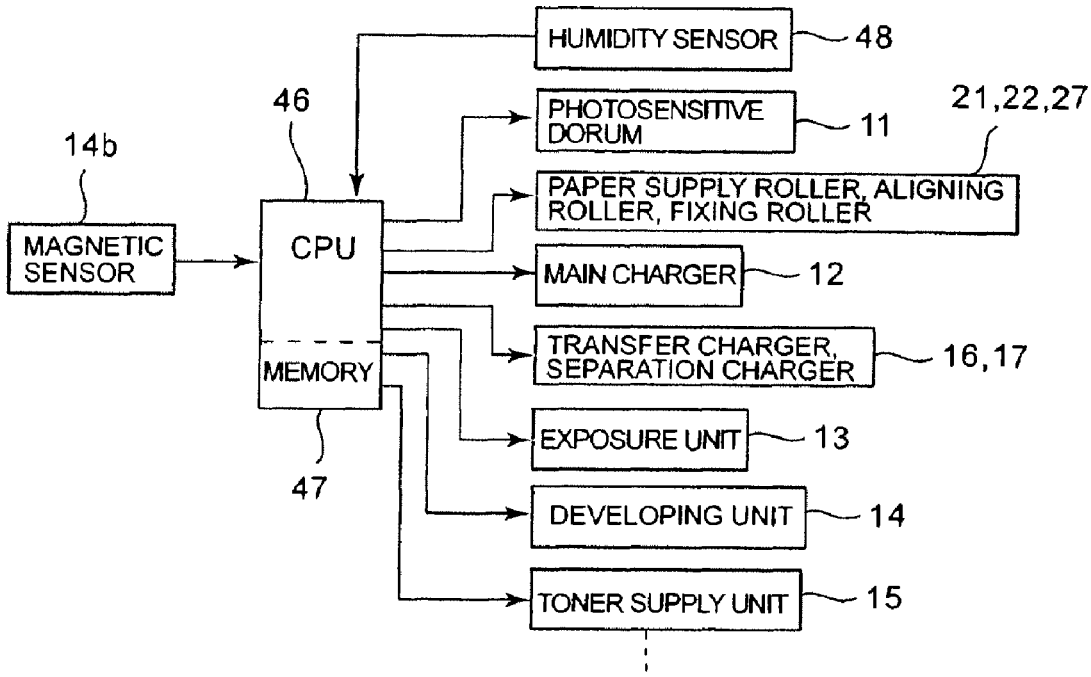
FIG. 4 is a block diagram showing a control system of a developing unit in the first embodiment of the present invention.

The control system of developing unit 14 controls a toner supply unit 15 according to the output from magnetic sensor 14*b* and specific density of toner in developing unit 14 by a CPU 46 that controls the entire image forming apparatus as shown in the block diagram in FIG. 4. A detecting result of a humidity sensor 48 in the main body of the image forming apparatus is input to CPU 46 and according to this detecting result, CPU 46 adjusts control voltage value Vc that is input to magnetic sensor 14*b*. When specific density of toner in developing unit 14 drops, a magnetic resistance becomes large and the output value from analog output pin 42 of magnetic sensor 14*b* becomes higher than a specified value, a toner supply signal is output from CPU 46 and decolorizing toner is supplied to developing unit 14 from toner supply unit 15.

Magnetic sensor 14*b* adjusts a control voltage value Vc that is input through control input voltage pin 43 so as to output proper voltage from analog output pin 42 according to a specific density of toner of two-component developing agent normally when two-component developing agent in developing unit 14 is exchanged. The control voltage set by this adjustment is stored in a memory 47.

Developing unit 14 is so set that a supply amount of decolorizing toner by toner supply unit 15 is controlled by CPU 46 according to the output result of magnetic sensor 14 and amount of decolorizing toner adhered to photosensitive drum 11 becomes below 0.75 mg/cm$^2$. This is to make the toner remaining on a paper P less when toner image color is erased for reusing the paper P.

The following test were carried out about decolorizing characteristic to the amount of adhesion of decolorizing toner. For this test, Paper P-50S weighing 64 g/m$^2$ manufactured by Toshiba Tech was used. A 10 mm×10 mm square solid patch of image density 2.0 was used as a document image. A document image can be a copied document or an electronic file printed document. After forming a 10 mm×10 mm patch electrostatic latent image corresponding to a document image on the photosensitive drum, toner patches in differing densities were obtained by adjusting the developing density. The developing density was adjusted by adjusting specific density of toner of developing agent, developing bias or ratio of peripheral velocity of the developing roller to the photosensitive drum, etc.

In one test conducted, after transferring one toner patch on a sheet of paper under the same condition, the patch was fixed, the color was erased with an exclusive use decolorizing device and the image density after decolorizing was measured with a Macbeth densitometer RD-913 (made by Macbeth). In another test conducted, another patch was fixed on the photosensitive drum using a piece of mending tape of which weight was measured in advance and the weight of the fixed toner patch was measured, and the weight M (mg) of the toner patch was measured from a difference in the weights before and after the taping, adhered amount of M' (mg/cm$^2$) on the photosensitive drum was obtained from an area of the toner patch.

Figure 5:
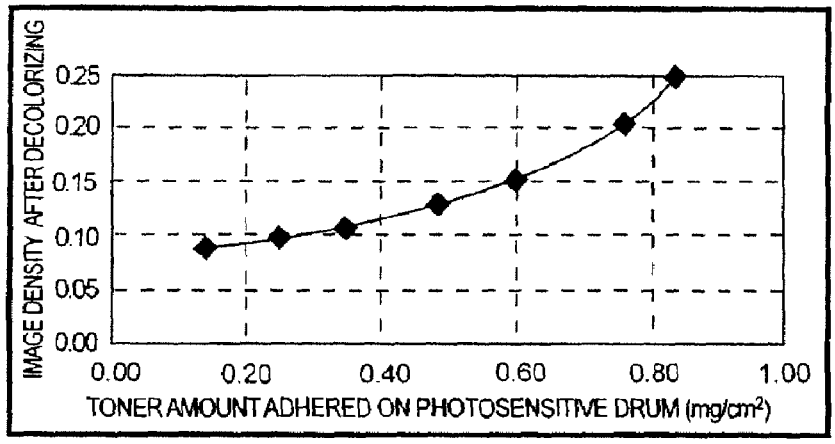
FIG. 5 is a graph showing the relation between amount of toner adhered on a photosensitive drum and the image density on a sheet after the image color erase in the first embodiment of the present invention.

The relation of the image density on a paper after decolorizing an image against amount of toner (mg/cm$^2$) adhered on the photosensitive drum is shown in FIG. 5. From FIG. 5, it was found that the decolorization of decolorizing toner on a paper drops and the image density after erasing the image on a paper exceeds 0.2 when amount of toner M' adhered the paper exceeds 0.75 (mg/cm$^2$). Thus, when the image density remaining on a paper is more than 0.2, the previous remaining image becomes conspicuous when next data is printed and a new printed data becomes hard to read. So, in this embodiment, amount of decolorizing toner is so set that its amount adhered to photosensitive drum 11 becomes below 0.75 mg/cm$^2$.

However, the developing characteristic of developing unit 14 is varied depending on an environment. For example, when the life tests were conducted on 60,000 sheets of paper by setting developing bias of developing roller 14*a* at −550V, a ratio of peripheral velocity of developing roller 14*a* to photosensitive drum 11 at about 1.6 times, toner specific density of two-component developing agent at about 2.5 wt % and under the environment of 10° C./20% RH and 30° C./75% RH, amount of toner adhered on photosensitive drum 11 was 0.75 (mg/cm$^2$) in both cases. Further, when a toner image on photosensitive drum 11 was transferred and fixed and then, decolorized by an exclusive decolorizing device, the image density after decolorizing was below 0.2.

Next, under the environment of 30° C./85% RH at the same conditions, amount of toner adhered on photosensitive drum 11 became 0.8 (mg/cm$^2$) when data was taken after leaving for 8 hours. Further, when a toner image on photosensitive drum 11 was transferred on a paper, fixed and decolorized by an exclusive use decolorizing device, the image density after erasing the image became 0.22 and decolorization was deteriorated.

The increase of adhered amount of toner when left in the environment at 30° C./85% RH for 8 hours is due to fluctuation in the output value from analog output pin 42 of magnetic sensor 14*b* as a result of increase in humidity in addition to drop of charge amount of decolorizing toner resulting from the increase of humidity.

In other words, under the environment of 30° C./85% RH, charge amount of decolorizing toner in two-component developing agent drops for increase in humidity and amount of toner adhered to an electrostatic latent image forming on photosensitive drum 11 increased. In addition, the output value from analog output pin 42 became high, a toner supply signal was output from CPU 46 and actual toner specific density became high and as a result, adhered amount of toner to an electrostatic latent image formed on photosensitive drum 11 was increased and decolorization of toner was remarkably dropped. The toner specific density in developing unit 14 after left for 8 hours under the environment of 30° C./85% RH was actually increased up to about 4.0 wt %.

Figure 6:
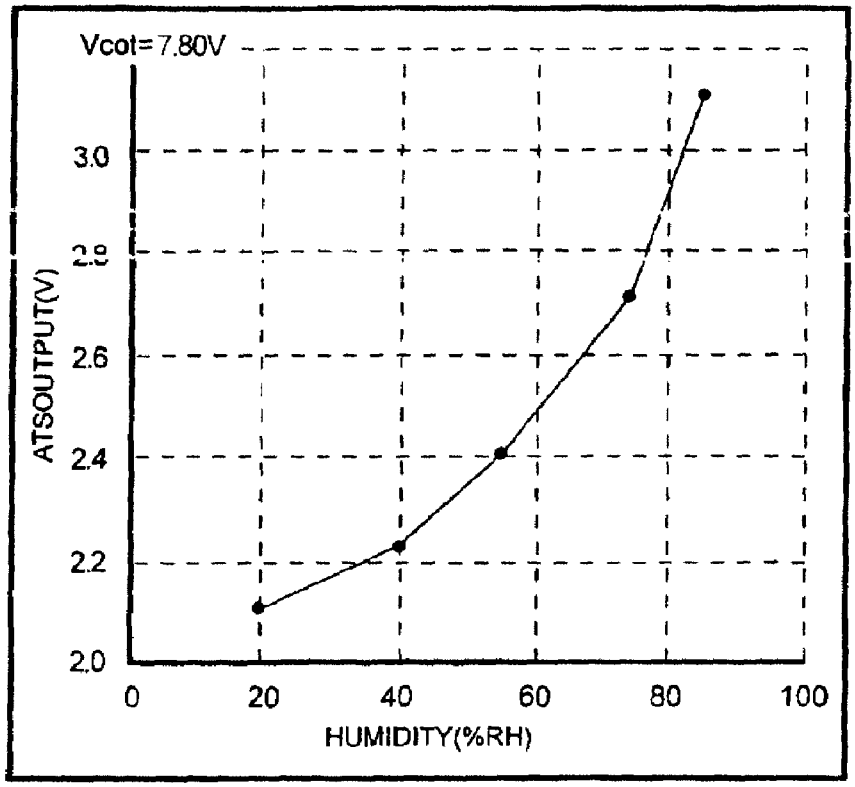
FIG. 6 is a graph showing the relation between relative humidity and ATS output value in the first embodiment of the present invention.

Magnetic sensor 14*b* adjusts control voltage value Vc when exchanging two-component developing agents in developing unit 14 and stores in a memory 47. However, when this control voltage value Vc thus set in memory 47 was used directly, the output value (ATS output) from analog output pin 42 is changed by fluctuation of environmental conditions, especially relative humidity as shown in FIG. 6. FIG. 6 is a graph showing fluctuation of ATS output value when relative humidity is changed in the state wherein a control voltage value Vc=7.8V was stored in memory 47 and kept at 7.8V when ATS output value was adjusted to 2.4V at relative humidity 55% RH. For example, ATS output value becomes 2.7V at relative humidity 75% RH and 3.1V at relative humidity 85% RH. Accordingly, when control voltage value Vc is kept stationary at 7.8V, ATS output value becomes high against actual toner specific density by fluctuation in relative humidity. Then, a toner supply signal is output from CPU 46 until ATS output value drops to about 2.4V. As a result, specific density of toner in developing unit 14 after left for 8 hours under the environment of 30° C./85% RH increased up to about 4.0%.

Figure 7:
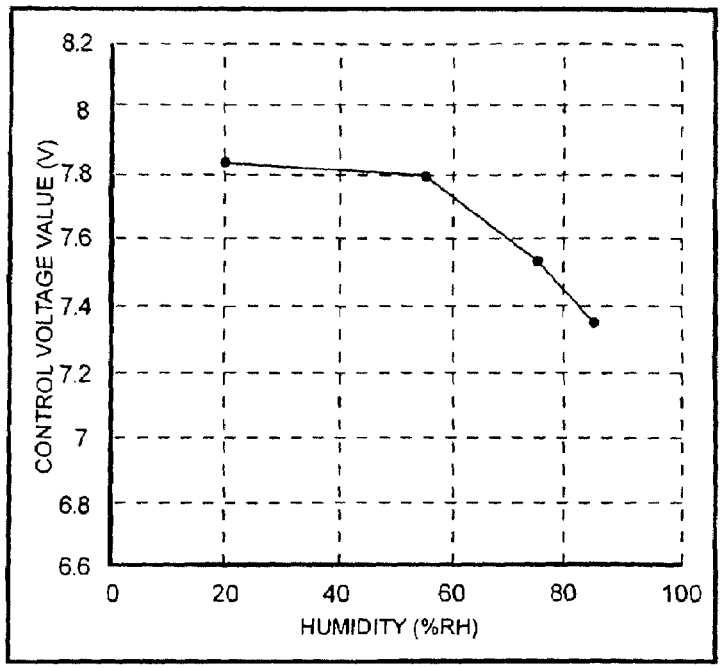
FIG. 7 is a graph showing the relation between relative humidity and control voltage value Vc in the first embodiment of the present invention.

Therefore, despite of fluctuation of humidity, control voltage value Vc that is input to magnetic sensor 14*b* is corrected and controlled by CPU 46 so that specific density of toner in developing unit 14 is not varied. That is, when developing agent of specific density of toner about 2.5 wt % was input into developing unit 14, left for 8 hour at a different humidity and control voltage value Vc was adjusted to make ATS output value to 2.4V, the results shown in a graph in FIG. 7 were obtained. Based on the graph in FIG. 7, prepare an approximate expression shown below, correct and control the control voltage value Vc input to magnetic sensor 14*b*. However, when an approximation is made using (Expression 1), relative humidity below 50% RH can be a fixed value.

$$Y=-0.0002x^2+0.0133x+7.6325 \quad \text{(Expression 1)}$$

Thus, specific density of toner in developing unit 14 is maintained at about 2.5 wt % even under the environment of 30° C./85% RH. When a printing test was conducted after the control voltage value Vc was corrected/controlled and left for 8 hours under the environment of 30° C./85% RH, amount of toner adhered to photosensitive drum was 0.65 (mg/cm$^2$), image density after erasing by an exclusive decolorizing devise was 0.17 and a good decolorization could be obtained.

Next, the operations will be described. When the image forming process starts, in image forming unit 10, photosensitive drum 11 rotating in the arrow direction s is charged to −750V uniformly by main charger 12, a laser beam is irradiated corresponding to document data by exposure unit 13 and an electrostatic latent image is formed. Then, this electrostatic latent image is developed with an decolorizing toner by developing unit 14 and a toner image in an decolorizing toner is formed on photosensitive drum 11.

At this time, specific density of toner of two-component developing agent in developing unit 14 is set at about 2.5 wt %. Further, control voltage value Vc of magnetic sensor 14*b* is controlled according to an approximate expression prepared based on the graph shown in FIG. 7 by CPU 46 corresponding to the detection result of humidity sensor 48. For example, at relative humidity 55% RH, control voltage value Vc is controlled to 7.8V. Thus, when specific density of toner of two-component developing agent in developing unit 14 is about 2.5 wt %, the ATS output value becomes 2.4V. Further, for example, at relative humidity 85% RH, control voltage value Vc is controlled to 7.25V. Thus, when specific density of toner of two-component developing agent in developing unit 14 is about 2.5 wt %, the ATS output value becomes 2.4V.

Accordingly, developing unit 14 is supplied with decolorizing toner from toner supply unit 15 by CPU 46 so that ATS output value from magnetic sensor 14*b* will become 2.4V irrespective of fluctuation in environmental humidity and specific density of toner of two-component developing agent is kept at about 2.5 wt %. Further, the toner adhered on photosensitive drum 11 of developing unit 14 of which specific density is thus controlled is made to below 0.75 (mg/cm$^2$).

On the other hand, for example, a specified paper P supplied from paper supply cassette unit 20 is sent to the position of transfer charger 16 in sync with a toner image on photosensitive drum by aligning roller 22 and a toner image on photosensitive drum 11 is transferred thereto.

Next, the paper P is separated from photosensitive drum 11, passes between fixing roller 27 and pressure roller 28 and the toner image is heated, pressed and fixed. After completing the fixing, the paper P is discharged in the specified direction by a paper discharge roller 32. After completing the transfer, photosensitive drum 11 is cleaned by removing residual toner with a cleaner 18, the remaining charge is removed by a charge eliminating LED and the image forming process is terminated.

A toner image color formed on the paper P corresponding to image data as described above is erased for reusing the paper after completing the process. The toner image color is erased by heating, for example, in Toshiba exclusive erasing unit "e-blue Decolorizing Device: TMD-HE01" at 120 to 150° C. for about 2 hours and automatically cooled for about one (1) hour. The image density on the paper P after decolorizing the toner image was equal to or less than 0.2. Further, when reusing the paper P, plural paper P heated and stuck slightly each other when heated are slackened lightly and supplied to paper supply cassette unit 20. Thereafter, the reuse paper supplied to paper supply cassette unit 20 is provided for the image forming according to the process described above. The toner image forming and decolorizing are repeated and when the paper P is deteriorated, it is processed for the recycling.

According to this first embodiment, when the amount of toner adhered to photosensitive drum 11 by developing unit 14 is controlled to below 0.75 (mg/cm$^2$), the image density after the decolorizing by an decolorizing device for reusing a paper P after transferring an image on the paper can be reduced to below 0.2 and a good decolorization can be obtained. Accordingly, when a new data is printed next on a reuse paper P, a remaining image previously printed is not conspicuous and the new printed data can be easily read and a good reuse paper can be supplied. Further, when a control voltage value of magnetic sensor 14*b* is controlled, it becomes possible to prevent fluctuation of specific density of toner of two-component developing agent irrespective of environmental changes, supply good reuse sheets of paper and easily maintain toner adhering amount to below 0.75 (mg/cm$^2$) by preventing fluctuation of amount of toner adhered to photosensitive drum 11 resulting from the environmental changes. Therefore, it becomes possible to maintain a good decolorization when reusing paper P irrespective of the environmental changes.

Next, a second embodiment of the present invention will be explained. This second embodiment is the same as the first embodiment described above excepting the control of amount of adhered toner. On this second embodiment, therefore, the same components described in the first embodiment will be assigned with the same reference numerals and the detailed explanation thereof will be omitted.

Figure 8:
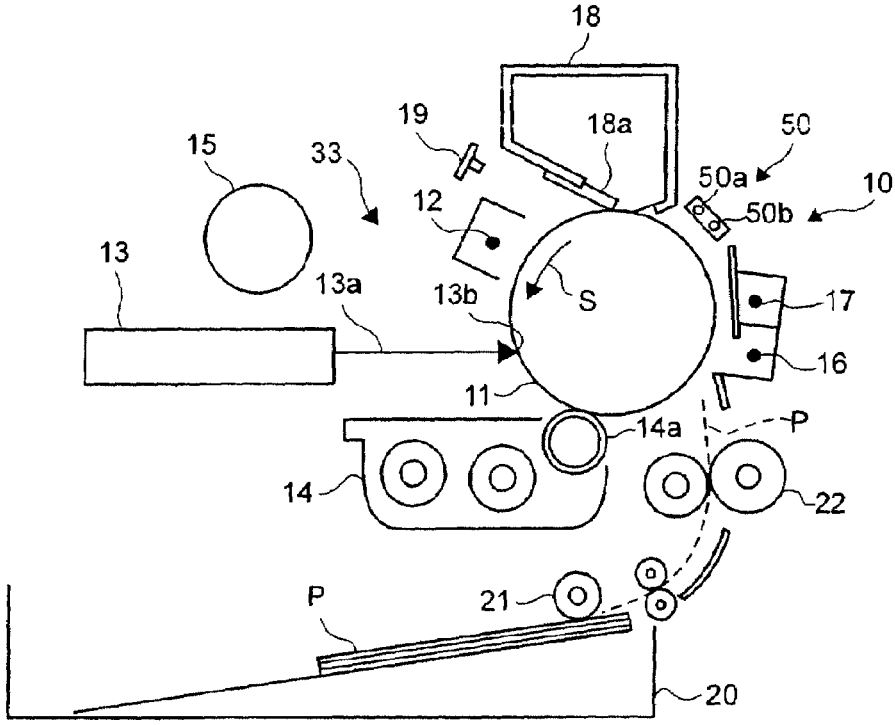
FIG. 8 is a schematic construction diagram showing an image forming unit of an image forming apparatus in a second embodiment of the present invention.

In the second embodiment, amount of toner adhered on the photosensitive drum is controlled to 0.75 (mg/cm$^2$) or below by detecting a toner amount adhered on photosensitive drum and controlling the process of image forming unit 10 utilizing the well-known image quality maintenance/control technology as a technique to control amount of toner adhered on photosensitive drum. In the second embodiment, an image maintenance sensor 50 comprising an infrared sensor at nearly the central portion in the longitudinal direction of photosensitive drum between separation charger 17 and cleaner 18 of photosensitive drum 11 as shown in FIG. 8. This image quality sustaining sensor 50 detects an amount of toner adhered to a reference density patch formed at the nearly the center in the longitudinal direction of photosensitive drum 11 when the image quality maintenance control starts.

Figure 9:
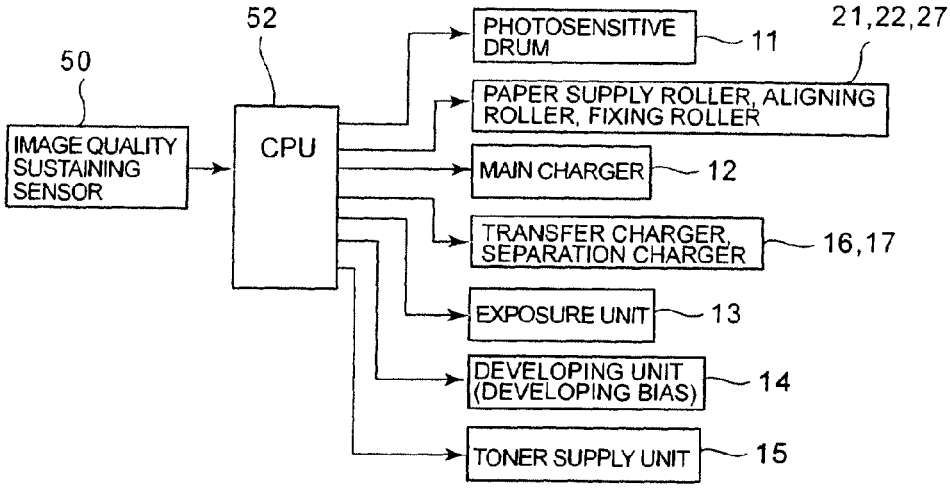
FIG. 9 is a schematic construction diagram showing an image maintenance control system of the image forming apparatus in the second embodiment of the present invention.
Figure 10:
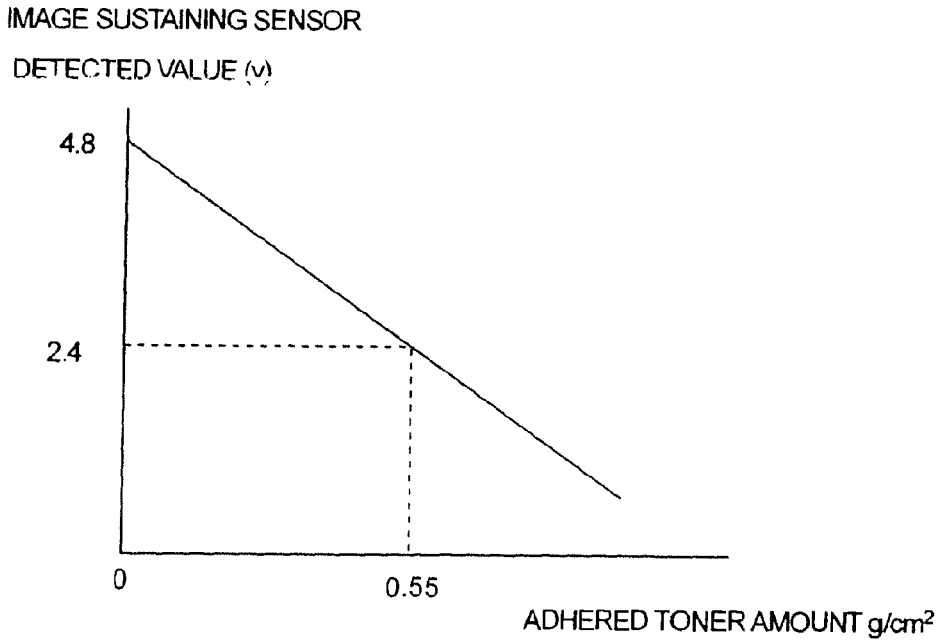
FIG. 10 is a graph showing the relation between amounts of toners adhered on the photosensitive drum in the second embodiment of the present invention.

Image quality sustaining sensor 50 receives the light reflecting on a photo acceptance from the surface of photosensitive drum 11 and converts it into electric signal and outputs. Image quality sustaining sensor 50 is an image quality maintenance controller and is connected to the input side of CPU 52 which controls the entirety of the image forming apparatus as shown in a block diagram of the image maintenance/control system in FIG. 9. CPU 52 controls an amount of toner adhered to photosensitive drum 11 by controlling charge voltage of main charger 12 or developing bias of developing roller 14*a* according to a detecting result of image quality sustaining sensor 50. A detected value of image quality sustaining sensor 50 is so set that it changes according to an amount of toner adhered on photosensitive drum 11 as shown in FIG. 10.

Further, a reference density patch is formed by developing a 10 mm×10 mm square solid patch obtained by optionally setting surface potential by main charger 12, developing bias to be applied to developing roller 14*a* and specific density of toner of two-component developing agent which are conditions for the image forming process by image forming unit 10. In this embodiment, the image quality maintenance is controlled by controlling the image forming process conditions by image forming unit 10 so that a value of reference density patch prepared on photosensitive drum 11 detected by image quality sustaining sensor 50 becomes, for example, 2.4V. Further, the starting conditions for the image quality maintenance control is when the image forming apparatus is at the warming-up after the power is turned ON and every 200 sheets.

Accordingly, at the time of warming-up after the power source of the image forming apparatus is turned on, a reference density patch is formed by rotating photosensitive drum 11 in image forming unit 10. For example, under the image forming processing conditions of surface potential −750V by main charger 12, developing bias to be applied to developing roller 14*a* and specific density of toner of two-component developing agent about 2.5 wt %, a 10 mm×10 mm square reference density patch is formed. Then, a toner amount of the reference density patch is detected by image quality sustaining sensor 50.

When the output from image quality sustaining sensor 50 is outside 2.4V, CPU 52 adjusts/controls either main charger 12, developing bias or specific density of toner of two-component developing agent or by combining them according to the output result from image quality sustaining sensor 50. Then, the image forming unit becomes in the ready state, the image forming job is carried out in the same manner as in the first embodiment described above according to the image forming processing conditions adjusted/controlled by CPU 52. When the number of image formed sheets reaches 200 sheets, the image forming job is suspended and the image quality maintenance/control is started again. After completing this image quality maintenance control, the succeeding image forming job is restarted. Similarly, the image forming job is suspended for every 200 sheets of image forming and the image quality maintenance/control is started.

When this image maintenance/control was performed and image forming tests were conducted under various environments, an amount of toner adhered on photosensitive drum 11 was between 0.5 to 0.6 (mg/cm$^2$) and the stabilized toner adhered amount was obtained. Further, when a toner image formed on photosensitive drum 11 was transferred on a paper P, fixed and further, the image was erased using an exclusive use color erasing device, the image density after erasing was below 0.2 and a good decolorization was obtained. In particular, even immediately after the power source was turned off after leaving the printed sheet for 8 hours under the high humid condition of 30° C./85% RH, a good decolorization was obtained.

According to this second embodiment, it becomes possible to obtain a good decolorization of toner images formed in decolorizing toner likewise the first embodiment when an amount of toner adhering on photosensitive drum 11 is controlled to 0.75 (mg/cm$^2$) or below when an image is formed, and good reuse sheets of paper can be supplied. Further, it becomes possible to maintain a toner adhering amount at 0.75 ($mg/cm^2$) or below easily irrespective of environmental changes by adjusting/controlling the image forming process conditions according to the detection results of the reference density patch by image quality retaining sensor 50. Accordingly, irrespective of the environmental changes, it becomes possible to maintain a good decolorization when reusing paper P.

Further, the present invention is not restricted to the embodiments described above but can be modified variously within the scope thereof and for example, a developing agent can be one-component developing agent comprising a decolorizing toner only instead of two-component developing agent. Further, when a sensor to detect specific density of toner when two-component developing agent is used can be an optical sensor or a similar product and toner specific density of two-component developing agent is not limited if a toner adhering amount to an image carrier can be maintained at 0.75 ($mg/cm^2$) or below. Furthermore, a mechanism to decolorize toner is not restricted if a color can be decolorized after fixed and a color can be optional. In addition, a heating temperature, a heating time and further a cooling time when erasing a color by heating are not limited. Further, the image quality maintenance control starting condition when executing the image quality maintenance control by detecting an amount of toner adhering on the surface of the image carrier is not limited and the image quality maintenance and control can be started every time when a new image forming job starts.

As described above, according to the present invention, an amount of toner adhering to an image carrier when forming an image is controlled to 0.75 ($mg/cm^2$) or below. Accordingly, a good decolorization of a toner image formed on a recording medium using a color decolorizing toner is obtained and a good reuse paper without an conspicuous remaining image can be supplied.

What is claimed is:

1. An image forming apparatus comprising:

an image carrier;

latent image forming means for forming an electrostatic latent image on the image carrier; and developing means for forming a toner image by adhering a decolorizing toner to the electrostatic latent image formed on the image carrier; and control means for controlling the developing means so that an amount of adhesion of the decolorizing toner to the image carrier becomes below 0.75 $mg/cm^2$.

2. The image forming apparatus as claimed in claim 1, wherein the developing means uses two-component developing agent containing the decolorizing toner and the control means controls a specific density of the two-component developing agent.

3. The image forming apparatus as claimed in claim 1, wherein the developing means includes a developing bias and the control means controls the developing bias.

4. The image forming apparatus as claimed in claim 1, wherein the latent image forming means includes a main charger to charge the image carrier and the control means controls the main charger.

5. The image forming apparatus as claimed in claim 1 further comprising:

an image quality sustaining sensor to detect amount of the decolorizing toner adhered on the image carrier; and image quality sustaining/control means for controlling the latent image forming means and/or the developing means from the detection result by the image quality sustaining sensor.

6. The image forming apparatus as claimed in claim 5, wherein the image quality sustaining sensor receives a light reflecting on a photo acceptance from the surface of the image carrier and converts the light into an electric signal and outputs.

7. The image forming apparatus as claimed in claim 1 further comprising:

an image quality sustaining sensor to detect amount of the decolorizing toner adhered on the image carrier, wherein the developing means uses two-component developing agent containing the decolorizing toner and the control means controls a specific density of the two-component developing agent according to a detection result of the image quality sustaining sensor.

8. The image forming apparatus as claimed in claim 7, wherein the image quality sustaining sensor receives a light reflecting on a photo acceptance from the surface of the image carrier and converts the light into an electric signal and outputs.

9. An image forming apparatus comprising:

a photosensitive drum;

a charger to uniformly charge the photosensitive drum;

a latent image forming unit to form an electrostatic latent image on the photosensitive drum; and a developing unit to adhere decolorizing toner to the electrostatic latent image formed on the photosensitive drum; and a controller to control the developing unit so that an amount of adhesion of the decolorizing toner to the photosensitive drum becomes below 0.75 $mg/cm^2$.

10. The image forming apparatus as claimed in claim 9, wherein the developing unit uses two-component developing agent containing the decolorizing toner and the controller controls a specific density of the two-component developing agent.

11. The image forming apparatus as claimed in claim 9, wherein the developing unit includes a developing bias and the controller controls the developing bias.

12. The image forming apparatus as claimed in claim 9, wherein the controller controls the main charger.

13. The image forming apparatus as claimed in claim 9 further comprising:

an image quality sustaining sensor to detect amount of the decolorizing toner adhered on the image carrier; and an image quality sustaining/controller to control the latent image forming unit and/or the developing unit from the detection result by the image quality sustaining sensor.

14. The image forming apparatus as claimed in claim 13, wherein the image quality sustaining sensor receives a light reflecting on a photo acceptance from the surface of the photosensitive drum and converts the light into an electric signal and outputs.

15. The image forming apparatus as claimed in claim 9 further comprising:

an image quality sustaining sensor to detect amount of the decolorizing toner adhered on the image carrier, wherein the developing unit uses two-component developing agent containing the decolorizing toner and the controller controls a specific density of the two-component developing agent according to a detection result of the image quality sustaining sensor.

16. The image forming apparatus as claimed in claim 15, wherein the image quality sustaining sensor receives a light reflecting on a photo acceptance from the surface of the image carrier and converts the light into an electric signal and outputs.

17. An image forming method comprising:

forming an electrostatic latent image on an image carrier;

adhering a decolorizing toner to the electrostatic latent image; and controlling the adhering step so that an amount of adhesion of the decolorizing toner to the image carrier becomes below 0.75 $mg/cm^2$.

18. The image forming method as claimed in claim 17, wherein the decolorizing toner is included in a two-component developing agent and the controlling step controls a specific density of the two-component developing agent.

19. The image forming method as claimed in claim 17, wherein the adhering step includes supplying a developing bias and the controlling step controls the developing bias.

20. The image forming method as claimed in claim 17, wherein the electrostatic latent image is formed on the image carrier by using a main charger and an exposure unit and the controlling step controls the main charger.

* * * * *